United States Patent [19]

Motsenbocker

[11] 4,306,989

[45] Dec. 22, 1981

[54] COMPOSITION FOR RELEASING ADHESIVES FROM A SURFACE

[75] Inventor: Gregg A. Motsenbocker, San Diego, Calif.

[73] Assignee: Lift-Off, Inc., San Diego, Calif.

[21] Appl. No.: 82,796

[22] Filed: Oct. 9, 1979

[51] Int. Cl.[3] ..... C11D 7/52; C11D 3/44

[52] U.S. Cl. ..... 252/162; 252/170; 252/171; 252/173; 252/364

[58] Field of Search ..... 252/114, 122, 153, 162, 252/170, 171, DIG. 14, 364, 172; 134/40

[56] References Cited

U.S. PATENT DOCUMENTS

| | | | |
|---|---|---|---|
| 2,212,761 | 8/1940 | Webster | 252/172 |
| 2,539,531 | 1/1951 | Clensos | 252/162 |
| 2,552,520 | 5/1951 | Coler | 252/170 |
| 2,613,186 | 10/1952 | Pickett | 252/170 |
| 2,697,674 | 12/1954 | Eisen | 134/26 |
| 3,093,592 | 6/1963 | Porcaro | 252/163 |
| 3,592,691 | 7/1971 | Stelter | 134/42 |
| 3,661,641 | 5/1972 | Vigh et al. | 134/6 |
| 3,789,118 | 1/1974 | Boerman | 424/45 |
| 3,915,902 | 10/1975 | Ancel et al. | 252/526 |
| 3,983,047 | 9/1976 | Vinson | 252/119 |

FOREIGN PATENT DOCUMENTS

| | | | |
|---|---|---|---|
| 584515 | 9/1933 | Fed. Rep. of Germany . | |
| 2422191 | 11/1975 | Fed. Rep. of Germany | 252/171 |
| 160416 | 5/1933 | Switzerland . | |
| 495766 | 11/1938 | United Kingdom . | |
| 1195164 | 6/1970 | United Kingdom . | |

*Primary Examiner*—P. E. Willis, Jr.
*Attorney, Agent, or Firm*—Donald D. Mon

[57] ABSTRACT

A liquid composition for releasing adhesives, especially pressure-sensitive adhesives such as are used on labels. The composition includes a solvent and a carrier, and may advantageously also include perfumes, surface cleaners, and emulsifiers. Among other uses it enables pressure sensitive labels to be lifted cleanly and expeditiously from a surface.

13 Claims, No Drawings

COMPOSITION FOR RELEASING ADHESIVES FROM A SURFACE

FIELD OF THE INVENTION

This invention relates to compositions for releasing adhesives from a surface, especially for releasing pressure-sensitive labels from surfaces such as food packages.

BACKGROUND OF THE INVENTION

It is frequently required to release adhesives from surfaces of objects without damaging the surface or the object. This is difficult to do, because the adhesive was designed to adhere very intimately to the surface or object. To remove the layer of adhesive immediately contiguous to the surface or object by mechanical means such as by scraping with a knife or spatula involves a considerable risk of scratching, and is rarely completely successful anyway. The use of abrasive compounds tends to dull or scratch the finish. It also is less than suitable.

Various solvents have been proposed for this purpose. However, known solvents and mixtures of solvents which are sufficiently effective to remove the adhesive by dissolving it generally are so strong that they can damage the surface, and so volatile that their effects are so short-lived that their use is troublesome.

Similarly, the removal of adhesive-backed labels from objects such as food packages is very difficult. In order to frustrate cheaters who would remove or alter the labels, they often are laid down in several separate adjacent segments. Attempts to remove such labels neatly by mechanical means are generally unsuccessful. The gum and the paper layers merely roll up or spread out, while still clinging to the surface. They make a mess.

There are solvents such as acetone, lighter fluid, or nail polish remover, which can be used to soften the adhesive under labels so the label can be scraped or peeled from a surface. Many of them are very flammable, and this is objectionable for many uses.

In addition, strong or active solvents can have an adverse effect on printing ink on labels or wrappings. They can and frequently do smear the printing, and can render a package unsuitable for sale.

Another problem with the use of strong or active solvents is that they must be left in contact with the adhesive or the label for a substantial period of time in order suitably to soften or dissolve the adhesive. They evaporate rapidly and do not provide sustained effects for extended periods of time. This requires the user to act quickly, or to repeat the process.

In times of rapidly rising food prices, labels on cans, boxes, foil and cellophane containers must frequently be removed in order that a new label with a new price can be applied. Because labor is costly, this work must be done quickly and efficiently, and the surface which remains should not require further treatment in order to accept a new label.

It is an object of this invention to provide compositions which act rapidly to release adhesives from surfaces so they and whatever they back, such as a label, can easily and quickly be removed from a surface or object without damage to the surface or deterioration of printed material.

It is yet another object of the invention to provide a composition which is quick-acting on labels, so that very soon after application to a label, the label is penetrated, the adhesive softened, and the label with the adhesive can be lifted cleanly with a blade, leaving behind a surface which does not require wiping or further treatment to be clean enough for sale, and for the reception of another gummed label. It is useful to remember that adhesives for labels are applied under optimal conditions, and are selected and applied so as to be quite adherent to the label itself. Therefore softening of the adhesive will preferentially release it from the surface, and it will accompany the label, when a composition according to this invention is used.

In accordance with this invention, a liquid composition is made up with a plurality of ingredients which exert mutually synergistic effects on adhesives and adhesive-backed labels. The ingredients include a first solvent, often having a high inherent volatility, that is selected for its property of being a good solvent for adhesives, and a carrier. The carrier is selected for a lower inherent volatility, so that the flammability of the total mixture is significantly reduced, for its "staying" power to remain without evaporation for a considerable time, and for its ability to dissolve the adhesive, or to hold in solution or suspension that which has been softened or dissolved by the first solvent. Advantageously, a second solvent can also be used. Preferably the first solvent is an aromatic, and the second solvent is a halogenated hydrocarbon solvent.

According to optional features of the invention, other components can variously be added to mask odors, to clean the surface, and to emulsify the composition if water is used as the carrier.

The above and other features of this invention will be fully understood from the following detailed description of the invention.

Compositions according to this invention include a first solvent for softening or dissolving adhesives, and a carrier. The first solvent should have good solvency for adhesives, but it may be quite volatile per se. The carrier should have a lesser inherent volatility to reduce the volatility of the system.

The presently preferred first solvent is xylene. Xylene is an excellent solvent for adhesives, is moderate in cost, and has a relatively low volatility compared to most other suitably effective solvents. The first solvent is preferably an aromatic compound. Other suitable aromatics can be substituted for xylene, in whole or in part. Examples of other suitable aromatic compounds are benezene, toluene, and cyclohexanone. The latter will usually be avoided in solutions which are to be used on printed surfaces because it can attack inks. Mixtures of some or all of these can also be used.

Although very suitable results can be obtained with the use of only a first solvent, it is frequently desirable to supplement the aromatics with a second solvent. Such a second solvent should be selected for the same purposes as the aromatics, namely primarily for effectiveness in softening or dissolving adhesives, and to the extent possible for volatility and low flammability. Halogenated hydrocarbon solvents are excellent for this purpose, because in general they are not flammable. Suitable halogenated hydrocarbons tend to be somewhat more expensive than suitable aromatics. The presently preferred second solvent is trichloroethylene. Other suitable compounds are perchloroethylene and 1-1-1-trichloroethane (methylchloroform). Mixtures of some or all of these can be used.

The carrier or carriers will be selected for effectiveness as solvent (which will ordinarily be less than that of the first and second solvents), and definitely for lower inherent volatility and lower flammability. The carrier should have adequate dissolving power of its own, or with the solvent or solvents, to keep the softened or suspended adhesive in solution or suspension even after much of the solvent or solvents has evaporated. Thus, the carrier gives the composition a "staying" power—it remains effective long enough for the user to apply the composition to a large number of labels, to let them "soak" for a short time, and then to go straight through them, lifting the labels, without concern that the composition would have evaporated and left the adhesive adherent again.

Petroleum distillates are excellent for the carrier, especially kerosene. However, petroleum distillates in boiling ranges from naphtha to and even including diesel fuel can function with varying degrees of effectiveness. Naphtha appears to be next preferred to kerosene. Also, when the compositions are to be emulsified, water can be used as a carrier.

The presently preferred non-water based formulation is as follows:

| | Preferred percentage | Range of Suitable Percentages |
|---|---|---|
| xylene | 20 | 5 to 50 |
| trichloroethylene | 35 | 0 to 80 |
| kerosene | 39-¼ | 10 to 95 |
| light mineral oil | 5 | 0 to 10 |
| lemon oil (as required) | ¾ | 0 to 5 |

Percentages as used throughout this specification are by volume. As can be seen, tricholorethylene can be eliminated entirely, or substituted in part for xylene. Some or no mineral oil, and some or no lemon oil may be used. Surfactants can be added in small amounts if desired.

Mineral oil can be added in small amounts. It serves surprisingly well to render removed, undissolved adhesives non-sticking so they can readily be wiped off. It also tends to leave a smooth clean surface after removal of adhesives to which surface a new label will readily adhere.

Surfactants can be provided to assist in the cleaning of the surface and to aid in suspension and emulsification. Suitable examples are TritonX-100 and TritonX-114, sold by Rohm & Haas, Sorbitan esters, or nonyl phenoxy polyethoxy ethanol.

If desired, coupling agents can also be added. An example is butylcellosolve, but it has the unfortunate capacity to attack printing inks. Generally speaking, it is frequently as well merely to shake the container before use, and to eliminate the coupling agent.

Suitable water-based formulations contain a first solvent, and may contain a second solvent. The carrier is water, but may include some petroleum distillate, especially naphtha or kerosene. A surfactant will ordinarily be used in minor amounts, and a coupling agent such as butylcellosolve can also be used.

The presently preferred water-based formulation is as follows:

| | Preferred Percentages | Range of Suitable Percentages |
|---|---|---|
| xylene | 15 | 5 to 30 |
| trichloroethylene | 0 | 0 to 30 |

-continued

| | Preferred Percentages | Range of Suitable Percentages |
|---|---|---|
| kerosene | 50 | 0 to 70 |
| water | 27 | 20 to 55 |
| surfactants | 6 | 2 to 15 |
| butylcellosolve | 2 | 0 to 2 |

In both the water based and the non-water based formulations, the specific substances preferred for use are given. In all cases, the substitutions discussed herein can be made (such as naphtha for kerosene), and the disclosure of the various specific substances is intended as a disclosure of the group of substances forming that class, and of the class itself.

The above formulations, and especially the two disclosed preferred formulations, quickly attack adhesive-backed labels and enable them to be lifted or scraped from a surface, leaving behind a clean surface receptive to a new label. They are safe and expedient to handle, and are modest in cost.

The terms "adhesive" and "pressure sensitive adhesive" are meant to include all adhesives which are conventionally used to apply labels, tapes, webs, sheets, or other materials to surfaces by means of applied pressure. Typical water soluble glues and pastes are not of interest to this invention. Typical adhesives of concern are water soluble and solvent-soluble systems, often but not exclusively based on acrylics, latexes, or synthetic rubbers. The formulations disclosed work very well on these.

The utility of this invention is not limited to the release of labels or other materials. It can be used to clean a surface of adhesives. Also, the material itself need not be penetrable by the composition. Instead it is quite possible to use it while peeling the material, by applying it at the edge.

The terms "softening" and "dissolving" are used in their broadest sense. The adhesives of concern need not go into a clear solution in order to be released. The interaction of this composition with it tends to make it somewhat softer, and sufficiently less adherent, that the label, strip, or other material readily comes loose, generally with the layer of adhesive still on it. For this reason, the term "release" is used to describe the operation of the composition.

The term "adhesive" is not limited to pressure-sensitive materials applied to labels, although that is expected to be the area of greatest utility of this invention. Conventional gum types are also worked on advantageously. In addition, chewing gum, and similar sticky substances, are readily attacked, especially by the water-based formulations. The water-based formulations readily remove chewing gum from the hair, and from floor and furniture. Chewing gum and other adhesives as mentioned, are included in the term "adhesive" as used in this specification and in the claims, and the term "surface" includes any body or surface to which the adhesive adhered—packages, furniture, hair, and the like.

This invention is not to be limited by the described embodiments, which are given by way of example and not of limitation, but only in accordance with the scope of the appended claims.

I claim:

1. A composition for releasing adhesive from a surface, comprising: a liquid first solvent having the inherent capacity to soften or dissolve said adhesive, said first solvent being selected from the group consisting of xylene, benzene, toluene, cyclohexanone, and mixtures of two or more thereof, a second solvent selected for an inherent capacity to soften or to dissolve said adhesive, and a lower flammability than said first solvent, said second solvent being selected from the group consisting of trichloroethylene, perchloroethylene, and 1-1-1trichloroethane and mixtures of two or more thereof, and a liquid carrier having a lesser inherent volatility than said first solvent, whereby to render to volatility of the composition less than that of the first solvent, and the capacity to keep the adhesive softened even after some of said first solvent has evaporated, said carrier being a liquid petroleum distillate in the boiling range between about that of naphtha through about that of diesel fuel, and present in proportion sufficient to accomplish said reduction of volatility and capacity to keep said adhesive softened after evaporation of said first solvent, both of said solvents being present in substantial quantity whereby each contributes to the softening of said adhesive, and in such total proportion relative to said carrier that said adhesive is softened by them.

2. A composition according to claim 1 in which said first solvent is xylene.

3. A composition according to claim 1 in which said carrier is kerosene.

4. A composition according to claim 1 in which said second solvent is a mixture of perchloroethylene and trichloroethylene.

5. A composition according to claim 4 in which said first solvent is xylene, and said carrier is kerosene.

6. A composition according to claim 5 in which about ¾% of lemon perfume is substituted for an equal percentage of kerosene.

7. A composition according to claim 1 which said first solvent is xylene, and said second solvent is trichloroethylene.

8. A composition according to claim 1 in which said first solvent constitutes about 20%, said second solvent about 35%, and said carrier about 40%, all by weight of the named ingredients.

9. A composition according to claim 1 in which said composition further includes mineral oil to render removed adhesives non-sticking, and to leave a clean surface after removal of adhesive to which a new adhesive will readily adhere.

10. A composition according to claim 9 in which said mineral oil is present as about 5% by weight of the named ingredients.

11. A composition according to claim 10 in which said first solvent constitutes about 20%, said second solvent about 35%, and said carrier about 40%, all by weight of the named ingredients.

12. A composition according to claim 11 in which said first solvent is xylene, said second solvent is trichloroethylene, and said carrier is kerosene.

13. A composition according to claim 11 in which said first solvent is xylene, said second solvent is a mixture of 1-1-1 trichloroethylene and perchloroethylene, and said carrier is kerosene.

* * * * *